United States Patent [19]

Dornier

[11] Patent Number: 4,475,417

[45] Date of Patent: Oct. 9, 1984

[54] EQUIPMENT FOR GAS-SINGEING RUNS OF TUBULAR TEXTILE MATERIALS

[75] Inventor: Peter Dornier, Lindau, Fed. Rep. of Germany

[73] Assignee: Lindauer Dornier Gesellschaft mbH, Fed. Rep. of Germany

[21] Appl. No.: 320,832

[22] Filed: Nov. 12, 1981

[30] Foreign Application Priority Data

Dec. 16, 1980 [DE] Fed. Rep. of Germany ..... 3047352

[51] Int. Cl.[3] ..... D06C 9/02

[52] U.S. Cl. ..... 26/3; 26/81; 26/85

[58] Field of Search ..... 26/3, 4, 5, 81, 85; 28/174; 432/8, 59

[56] References Cited

U.S. PATENT DOCUMENTS

| | | | |
|---|---|---|---|
| 1,082,992 | 12/1913 | Baum | 26/85 X |
| 2,274,600 | 2/1942 | Hanes | 26/3 |
| 2,781,589 | 2/1957 | Cornwell | 26/81 X |
| 3,501,818 | 3/1970 | Heitkamp | 26/85 |
| 4,269,046 | 5/1981 | Strahm et al. | 26/85 X |

FOREIGN PATENT DOCUMENTS

| | | | |
|---|---|---|---|
| 39-928 | 2/1964 | Japan | 26/3 |
| 50-39186 | 12/1975 | Japan | 26/3 |
| 986565 | 3/1965 | United Kingdom | 26/3 |

*Primary Examiner*—Robert Mackey
*Attorney, Agent, or Firm*—James E. Bryan

[57] ABSTRACT

This invention relates to equipment for gas-singeing runs of textiles comprising a floating expander in which a cylinder spreads approximately cylindrically and which is used for a textile tubular fabric moving over it, and further comprising at least one annular structure surrounding the expander and acting as a support for a plurality of singeing means containing gas-burner nozzles and being displaceable in a radial and synchronous manner with respect to the expander.

13 Claims, 16 Drawing Figures

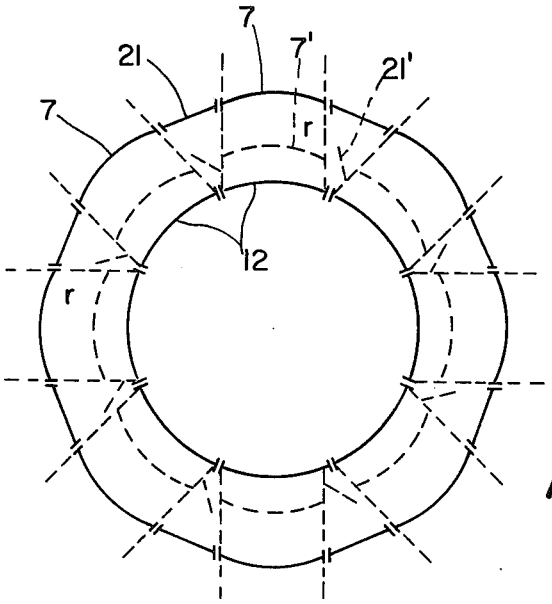
FIG. 8
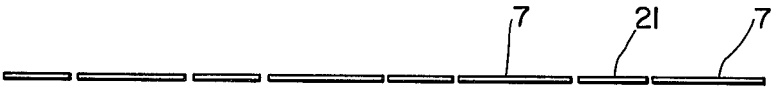
FIG. 9a
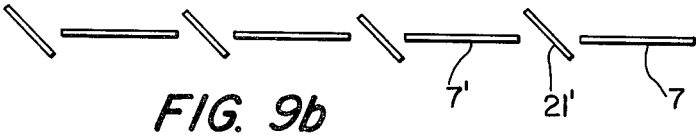
FIG. 9b
FIG. 10a
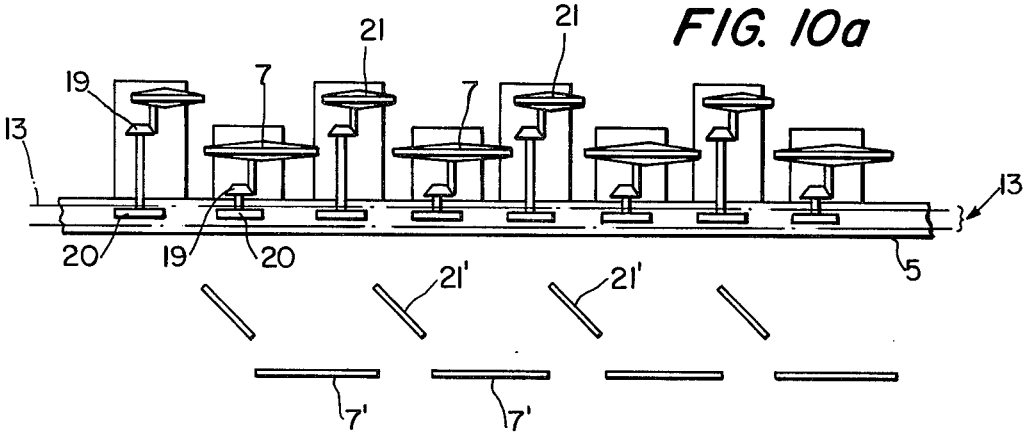
FIG. 10b

EQUIPMENT FOR GAS-SINGEING RUNS OF TUBULAR TEXTILE MATERIALS

This invention relates to equipment for gas-singeing runs of textiles. Singeing processes have long been known in the textile industry, by means of which free fiber ends projecting above the surface of textile fabrics, and frequently forming an undesired fibrous surface, are removed using a flame directed at the textile fabric. The textile fabric in this process is continuously moved past the flame. Quite often the fabric is so guided in the vicinity of the flame that it undergoes a bending or kinking and it is exposed to the flame on its outwardly curved side. Such a design for instance is described in German Pat. No. 119.929 and German Offenlegungsschrift No. 2,213,631.

The singeing effect across the entire width of the textile fabric is achieved by burners arranged in rows, which burners comprise a large number of gas burner nozzles arranged transversely to the direction of motion of the fabric. To achieve satisfactory singeing of the residual fibers while however at the same time keeping the ware itself sheltered from damage as much as possible, i.e., to prevent damage by the flame, the flame spacing and intensity must be precisely set and be determined with respect to the rate of motion of the run of fabric. The moment there is an unevenness or a stoppage in the course of continuous operation, action must be taken with respect to the flame. In order to remedy the difficulties that arise, many singeing processes not only evacuate the flame gases, but also the fabric guide means opposite the flame is cooled with water, as for instance described in the above-cited German Pat. No. 119,929. It is known from German Pat. No. 2,130,139 to apply a flow of cooling air, opposite in direction to the flame, to the side of the textile fabric away from the flame.

All previously known equipment for gas-singeing is applicable only to treating textile flat fabrics; it does not permit singeing textile tubular fabric.

It is the object of the present invention to remedy this shortcoming and to implement satisfactory gas-singeing also in the case of textile tubular fabrics.

This problem is solved by the invention by using a known floating expander which spreads approximately cylindrically in its diameter, over which the textile tubular fabric passes, and by using at least one annular structure enclosing the expander, acting as the support for a plurality of singeing heads containing gas burner nozzles, and being radially and synchronously displaceable with respect to the expander.

The invention will be further illustrated by reference to the accompanying drawings, in which:

FIG. 1 schematically shows a circular expander for tubular fabric with the arrangement of singeing heads;

FIG. 2 is a cross-section of FIG. 1;

FIG. 2*a* is a simplified view of a portion of FIG. 1;

FIG. 3*a* is an elevation of a singeing head as viewed from the side of the fabric;

FIGS. 3*b*, 3*c* and 3*d* are an arrangement of singeing heads according to FIG. 3*a* when geometrically developed;

FIG. 8 is a top view of an arrangement of various singeing heads;

FIGS. 9*a* and 9*b* are an arrangement of various singeing heads geometrically developed, and FIGS. 10*a* and 10*b* are another arrangement of geometrically developed singeing heads with an adjustment mechanism shown in simplified manner.

Figure 1:
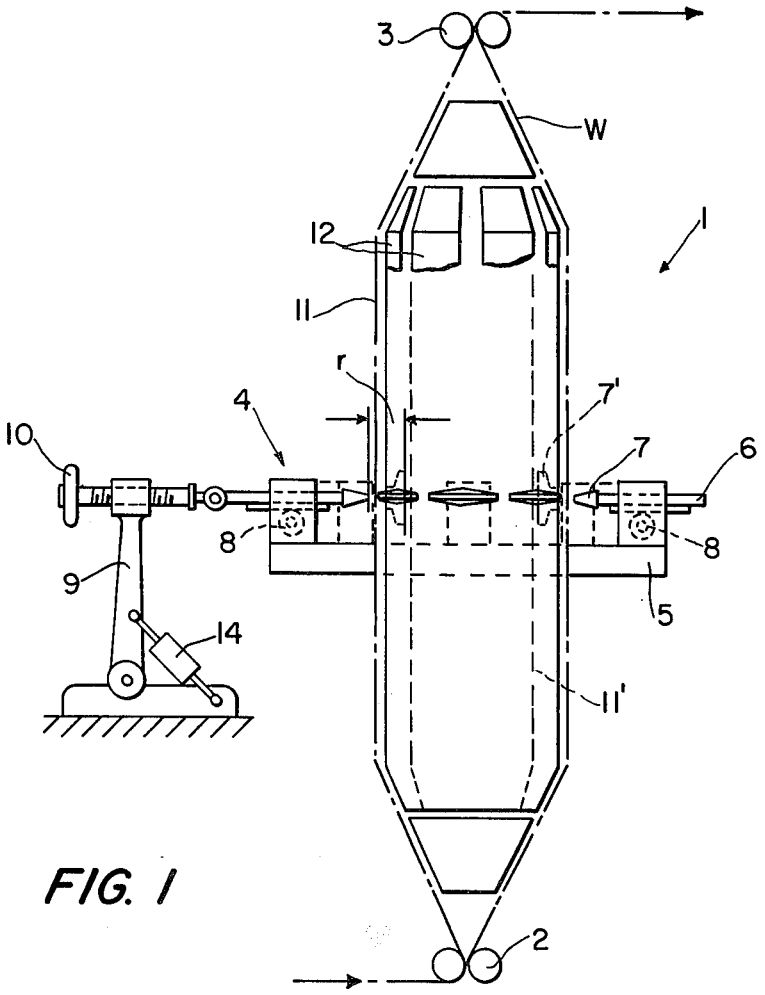

The principle of the invention will be explained first in relation to FIGS. 1 and 2. FIG. 1 shows a known circular expander 1 of an approximately cylindrical shape. It contains a number of longitudinal guide elements 12 extending in the longitudinal cylinder direction and indicated at the top in the drawing. These longitudinal guide elements can be radially spread, by a mechanism which is not shown in the drawings, and therefore they are adaptable to the width of the tubular fabric to be treated. There is obtained as a result, and as shown in a simplified manner in FIGS. 1 and 2 by the solid lines, the maximum external periphery of the expander 11, as opposed to the least contour 11' when the expander 1 assumes its least width, indicated by the dashed lines. The two contours 11 and 11' also are shown in FIG. 2.

The circular expander 1 is not the object of the invention, rather it is known and therefore its design and its adjustment, i.e., its diameter spreading, is not further discussed. The dash-dot indicated tubular fabric W is supplied in the direction of the arrow through the entry rollers 2 to the expander 1, and in the embodiment shown is moved upwardly over this expander and lastly is removed by means of the exit rollers 3. The gas-singeing equipment as a whole is denoted by 4 and completely surrounds the expander 1. The gas-singeing equipment 4 is composed of a ring 5 mounted in the transverse plane of the expander 1. The ring acts as a support for a number of singeing heads 7 distributed at equal spacings on the ring 5. The ring 5 need not be precisely circular, rather and depending upon the requirements, it also may have another shape. In the illustrative embodiment, this ring is spatially fixed with respect to the expander 1. The parts of the ring 5 located on the rear side of the expander together with the associated singeing heads are shown in dashed lines in FIG. 1.

In a further development of the invention, it is not necessary that the singeing heads 7 be all located in one common transverse plane of the expander, as shown in FIG. 1, rather they may also be mounted in different transverse planes. For instance, FIG. 2*a* shows a simplified side view of FIG. 1, wherein the expander is omitted for the sake of clarity. In this selected embodiment, the singeing heads 7 are mounted at alternatingly different heights in two transverse planes on the single ring 5.

Figure 2:
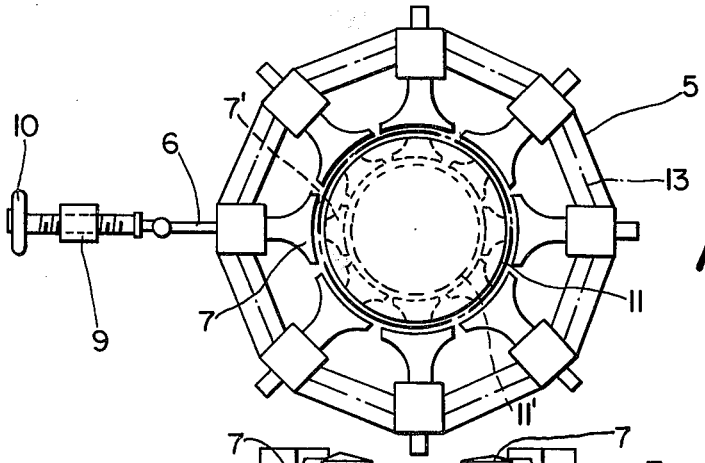
Figure 2A:
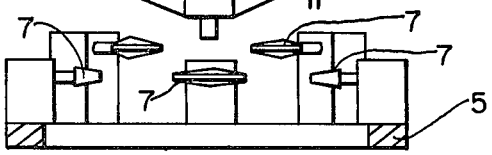

As can be seen from FIG. 2, when the expander is in the spread position, that is for the outer contour 11, the singeing heads are so arranged as to be tightly against each other and entirely surround the expander 1. The forward boundary of the singeing heads 7, which boundary faces the fabric W, is approximately adapted to the curvature of the outer contour 11 of the expander.

As mentioned above, the longitudinal guide elements are radially adjusted to adapt the expander 1 to other diameters of the tubular fabric W. Correspondingly, the singeing heads 7 also are displaced radially into a new position 7'. The spacing between the singeing head and the fabric remains constant. The extent of the radial displacement of the singeing heads between their positions 7 and 7′ is denoted by r in FIG. 1. To radially displace the singeing heads 7, gear racks 6 are provided here for simple illustration as the holding means for the singeing heads 7. The gear racks 6 engage a drive element, for instance a pinion 8, for every singeing head. Obviously other designs of drive elements can be used. The drive elements 8 of all the singeing heads 7 are coupled together by one transmission and therefore can be displaced synchronously and uniformly. The transmission for instance may be a chain drive 13 indicated in FIG. 2 in dot-dash lines and securely housed in the annular structure 5. In lieu of the simple chain drive, other transmission means such as universal joint shafts can be used to couple the individual singeing heads together.

A fine control may be provided for every singeing head 7, in a manner not further described, by means of which the spacing between the singeing head 7 and the fabric W can be set precisely at each singeing head. Due to the driving coupling between the individual singeing heads 7, there results a synchronous and uniform radial displacement when an adjustment is carried out at a selected singeing head 7. To that end, a handwheel 10 with a spindle is provided in the simplified illustrative embodiment. By rotating the handwheel 10, the singeing heads 7 are advanced or retracted. In lieu of a manual displacement of the singeing heads, it is also possible to provide a coupling at the adjustment transmission means to spread the expander 1.

To eliminate damage by the flames when the fabric is stopped, rapid shut-off is advantageous. To that end, the illustrative embodiment shows a radially displaceable thread for the adjustment spindle of the handwheel 10. This is implemented for instance by pivoting the support 9 containing the nut thread. In the event of a defect, this support is displaced, for instance automatically, by a pneumatic setting member 14. Similarly to the above-described manual adjustment, in this case also the retraction of the gear rack 6 by means of the coupling members 8 and 13 of the transmission results in the immediate withdrawal of all the singeing heads 7 into a harmless position. In this manner it is possible to obtain both the adaptation of the singeing heads 7 to the particular required diameter of the expander 1 and also the protection of the fabric W against any burning, using one and the same apparatus.

If the singeing heads 7 were displaced in a purely radial manner, then those tightly against one another, as shown in FIG. 2, would soon touch or overlap or jam upon a decrease in diameter of the expander 1. This can be remedied in that the singeing heads 7 perform a superposed motion of rotation when being radially displaced. This motion of rotation is indicated in FIGS. 1 and 2 for the position 7′ of the singeing heads. The singeing heads 7 shown in FIG. 1 no longer appear narrow when viewed from the side, rather they appear larger because of their oblique arrangement. Correspondingly, the singeing heads 7 in FIG. 2 appear smaller in top view in their advanced position 7′.

Figure 3A:
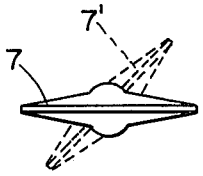
Figure 3B:
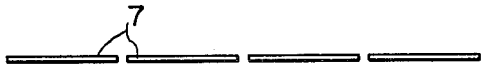
Figure 3C:
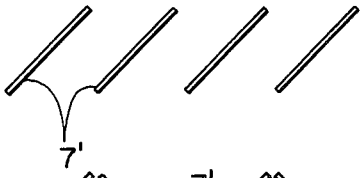
Figure 3D:
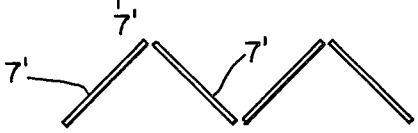

FIG. 3*a* shows a singeing head 7 as viewed from the fabric W. The position of the singeing head 7 corresponds to that shown in FIGS. 1 and 2 for the largest spreading of the expander 1. The forward boundary facing the fabric W therefore is visible as a narrow strip located in the transverse plane of the expander 1. If there is superposition of a rotation during a radial displacement of the singeing head, then this singeing head assumes the position 7′ shown in dashed lines. Again as viewed from the fabric, FIG. 3*b* shows a geometric development of the ring with a number of singeing heads tightly joining one another. The arrangement corresponds approximately to a half circle of the singeing head arrangement shown in solid lines in FIG. 2 for the maximum spreading 11 of the expander 1. In the simplified representation shown here, the forward boundary of the singeing heads, i.e., the burner nozzle, can be seen as a narrow slot. Due to the motion of displacement with superposed motion of rotation, the singeing heads assume approximately the position 7′ shown in FIG. 3*c*. It is shown in this geometric development also that when projected on a transverse plane of the expander, the obliquely set singeing heads 7′ join each other closely. If in lieu of a rotation of the singeing heads in the same direction an alternatingly different direction of rotation is chosen, then the singeing heads will be arranged in a zig-zag manner, the mutually adjoining ends linking up spatially. This arrangement is shown in FIG. 3*d*.

Figure 4:
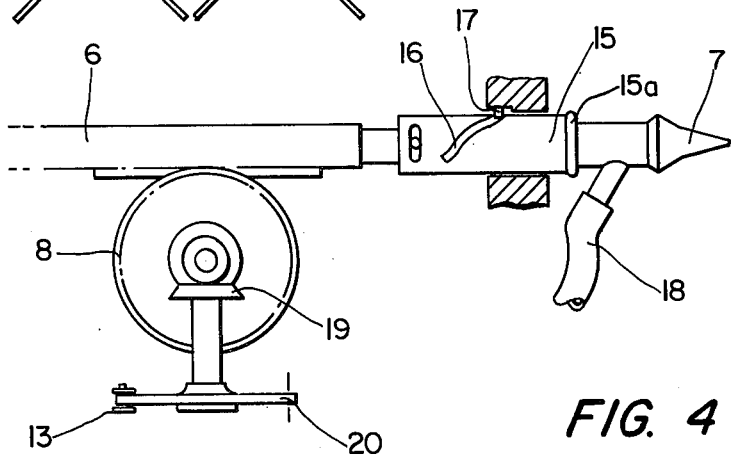
FIG. 4 is a side view of a singeing head with drive element.
Figure 5:
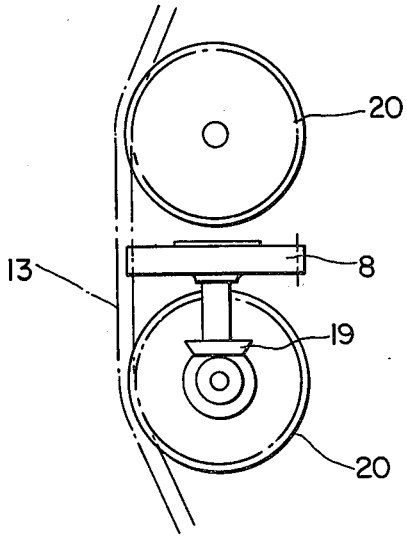
FIG. 5 shows the drive element of FIG. 4 in a top view.

FIGS. 4 and 5 show a simplified but enlarged example of the drive element and the transmission means for the singeing heads 7. FIG. 4 is similar to FIG. 1 as viewed from the side, whereas FIG. 5 represents a top view of FIG. 1. The singeing head 7 is supported by a gear rack 6. The displacement of the gear rack 6 is initiated by the handwheel 10 and spindle as is the case for FIG. 1. As the gear rack 6 engages the pinion 8, the displacement is transmitted to the pinion in the form of a rotation. The motion is transmitted by means of a cone-drive 19 to a horizontal sprocket wheel 20 and thereby the displacement of the gear rack 6 is transmitted to the chain 13. At each of the singeing heads 7 mounted on the annular structure 5, the motion is transmitted in the inverse order of the components to the particular gear rack 6. In lieu of the chain transmission 13, other transmission means such as universal joint shafts also can be used as coupling drive means. Again, other known drive means can be used in lieu of the rack and pinion.

FIG. 4 moreover indicates an example for the generation of the rotation of the singeing head 7. The singeing head 7 is rotatably mounted by means of a sleeve 15 to the gear rack 6. Using a pin, not further denoted, the singeing head 7 is carried along by the rack 6 in the radial direction. A guide pin 17 engages a guide groove 16 in the sleeve in a spatially fixed guide for the sleeve 15. When advancing or retracting the gear rack 6, these guide members superpose a rotation on the singeing head 7. The gas supply 18 also is indicated at the singeing head 7. Obviously other designs can be provided for the advance, rotation and gas supply. Illustratively, the singeing head 7 within the associated sleeve 15 can be displaced axially to some extent and in this manner the spacing between the singeing head and the material to be treated can be fine-controlled. A means of mutually fixing in place the singeing head 7 and the sleeve 15 is indicated by the tightening screw 15′.

Figure 6:
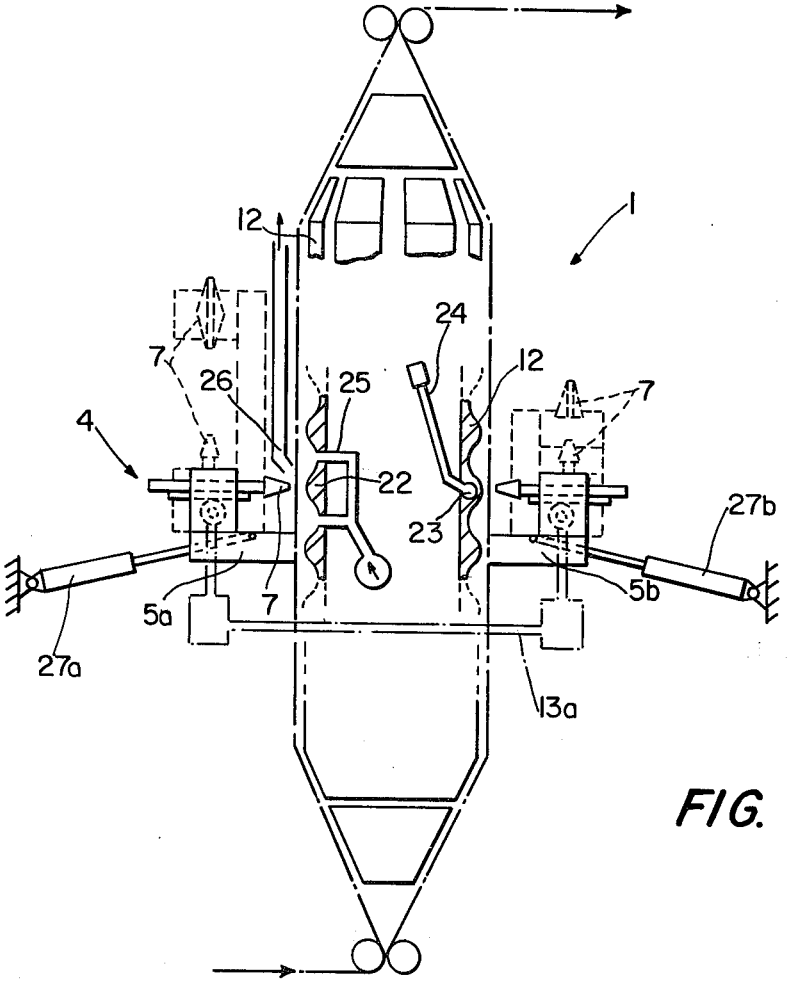
FIG. 6 is a variation on the design of FIG. 1.
Figure 7:
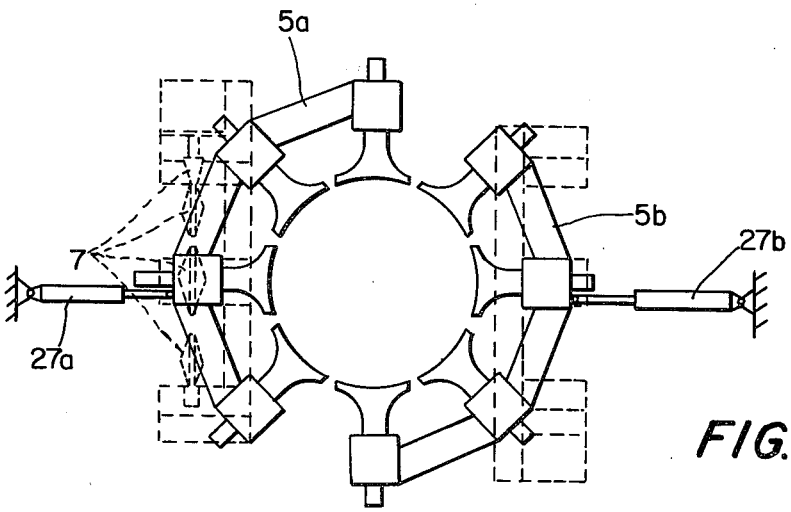
FIG. 7 is a cross-section of FIG. 6.

FIGS. 6 and 7 correspond approximately to FIGS. 1 and 2. The difference is that in this case the annular structure 5 is divided into two partial rings 5*a* and 5*b* which complement each other and together surround the expander 1. The drive elements for the singeing heads 7 are not shown. Each partial ring 5*a* or 5*b* is provided with its own drive chain 13 (not shown) of the type described in relation to FIGS. 4 and 5, respectively. The drive chains of both partial rings 5*a* and 5*b* are jointly driven by a coupling means. In case of difficulty, the following rapid disconnect is provided: the two partial rings 5*a* and 5*b* together with the singeing heads 7 they support are tipped over into the position shown in dashed lines. The burner nozzles therefore are in a position from which they cannot damage the fabric when the fabric, for instance, is stopped. The two partial rings 5*a* and 5*b* can be tipped up arbitrarily in known manner. FIGS. 6 and 7 show one possible embodiment in the form of pneumatic or hydraulic means. A setting member 27*a* acts on the partial ring 5*a* and on its actuation the partial ring 5*a* is tipped up into the position indicated by the dashed lines. Similarly a pneumatic setting member 27*b* is provided at the partial ring 5*b*.

FIG. 6 shows yet another possibility. In this case, the expander 1 is provided in known manner with wave-shaped longitudinal guide elements 12. The arrangement advantageously is such that the singeing heads 7 are opposite a wave peak 22. In this manner, an effect similar to the initially mentioned kinking in the material to be treated when flat textile runs are involved is obtained. Also the longitudinal element 12 may be provided with cooling means, at least in the area of the singeing heads 7. Not only the design of cavities 23 in the longitudinal guide elements 12 and the flow of a coolant through them are suited for that purpose but, furthermore, also the use of known heat pipes. The connection of a heat pipe 24 to a coolant-filled cavity 23 is shown in the right portion of FIG. 6. Again, cooling can be accomplished by blowing air. FIG. 6 shows passages 25 in the troughs next to the singeing heads 7 in the left portion of the drawing, air being blown from inside the expander through these passages against the lower side of the material, i.e., against that side which is away from the flame. Again, it is possible to evacuate the hot flame gases by suction; this being indicated by the evacuation pipe 26 with the direction of flow denoted by an arrow.

For the sake of simplicity, the expander was considered to be a circular cylinder in the above discussion. As already mentioned, such an expander ordinarily is composed of longitudinal guide elements 12 with a cross-section of arcs of a circle. When tightly arranged next to each other, the longitudinal guide elements 12 form the least diameter of the expander 1. They can be radially adjusted outwardly from this position. As this takes place, gaps are formed between them, which grow with increasing expander diameter. Therefore, a polygonal structure is created when spreading the expander 1 away from the purely circular cylinder shape, this polygonal structure evincing gently rounded edges and straight stretches in-between. The tubular ware moving over the expander is adapted to this geometry.

The arc-of-circle longitudinal guide elements 12 are shown in a much simplified manner in FIG. 8 as being tightly against each other in a position for which they form the least possible adjustable diameter of the expander 1. By radially adjusting these longitudinal guide elements 12, the approximately polygonal external structure shown in thick solid lines is obtained. The radial displacement is indicated by dashed parallel lines. As in FIG. 1, the extent of the radial displacement is denoted by r. As the longitudinal guide elements 12 and the singeing heads 7 opposite them are apart only by a relatively small gap, as a first approximation, the forward boundary of the singeing heads 7 in FIG. 8 can be assumed to be the same as the circular shape of the longitudinal elements 12. Similarly to the longitudinal guide elements 12, the singeing heads 7 also retain their circularity in a radial displacement. Accordingly, a gap always will be formed between the singeing heads 7 when the expander is being spread. As shown in FIG. 8, singeing heads of a second kind can be inserted into these gaps, with a forward boundary of these elements of the second kind being rectilinear, corresponding to the above-mentioned path of the tubular fabric. These singeing heads of the second kind are denoted by 21 in FIG. 8. If there is a radial displacement of the singeing heads 7 of the first, arc-of-circle kind into their position 7' shown in dashed lines, then the gaps between them will be altered. For that reason the singeing heads 21 of the second kind are rotated into a position 21' also shown in dashed lines. Therefore, all of the singeing heads no longer are rotated when there is a radial displacement, rather now only the singeing heads of the second kind with a straight forward boundary are rotated.

FIG. 9*a* shows the geometric development of the arrangement of singeing heads of various kinds. It is assumed that both kinds of singeing heads 7 and 21 are located in a common plane of the expander. If there is a radial adjustment, the singeing heads are all displaced and with the simultaneous rotation of the singeing heads 21 of the second kind, the singeing heads take up the positions shown in geometric development in FIG. 9*b*.

However, it is equally possible to mount the singeing heads of different kinds in separate transverse planes similarly as in FIG. 2*a*. Such an arrangement is shown in geometric development in FIG. 10*a*. The singeing heads 21 of the second kind (with rectilinear forward boundary) are offset behind the singeing heads 7 of the first kind so as to be between the gaps of the latter. When there is a radial displacement of all the singeing heads, the singeing heads of the first kind remain unrotated and assume the position 7' whereas the singeing heads 21 of the second kind are both displaced and rotated into the oblique position 21'. They always remain offset behind the gaps of the two neighboring singeing heads of the first kind. This position is shown in geometric development in FIG. 10*b*. The particular shortening of the length in the geometric development is clearly shown both in FIG. 10 and in FIG. 9 between the partial FIG. a and the partial FIG. b. FIG. 10*a* furthermore shows the gear parts 19 and 20 for the radial adjustment of the singeing heads 7 and 21, respectively. Again, the drive is by a common drive chain 13 passing through the ring 5. In this manner, it is easily possible to jointly adjust the singeing heads of the first and of the second kind and, insofar as required, to also convert the motion into a simultaneous superposed rotation.

It will be obvious to those skilled in the art that many modifications may be made within the scope of the present invention without departing from the spirit thereof, and the invention includes all such modifications.

What I claim is:

1. Equipment for gas-singeing runs of textiles, comprising an adjustable floating expander means in which a cylinder spreads approximately cylindrically and which is used for a textile tubular fabric moving over it, and further comprising at least one annular means surrounding the expander means and acting as a support for a plurality of singeing means containing gas-burner nozzles, the forward boundary of at least part of the singeing means being adapted to the curvature of the outer contour of the expander, means for displacing said singeing means in a radial and synchronous manner with respect to the expander means, whereby the singeing means can be adapted to the required diameter of the expander, and means whereby a rotational motion is superposed on the radial displacement of at least part of the singeing means, said rotation taking place about the axis of displacement of said singeing means in such a manner that neighboring singeing means when projected on a cross-sectional plane always closely adjoin one another.

2. Equipment according to claim 1 including means for the rapid retraction of the singeing means.

3. Equipment according to claim 1 in which said expander means has radially adjustable longitudinal guide elements, and including means for cooling the longitudinal guide elements at least in the vicinity of the singeing means.

4. Equipment according to claim 1 in which said expander means has a wavy surface, and said singeing means are positioned opposite a wave peak.

5. Equipment according to claim 1 in which said expander means has longitudinal guide elements that are arcs-of-circle in cross-section, and including a combination of two kinds of singeing means:

(a) singeing means which are adapted in their forward boundary shape to a circular form and are located opposite the arc-of-circle type of longitudinal guide elements, and (b) singeing means with a forward rectilinear boundary mounted between neighboring longitudinal guide elements.

6. Equipment according to claim 5 including means mounting the different kinds of singeing means in an annular fashion in separate transverse planes of the expander means.

7. Equipment according to claim 6 including means whereby both kinds of singeing means are synchronously radially adjustable.

8. Equipment according to claim 5 or claim 6 including means whereby the singeing means evincing a circular forward boundary are radially adjustable, and the singeing means evincing a forward straight boundary can be both radially adjusted and rotated about their axes.

9. Equipment according to claim 1 wherein the means for displacing the singeing means include a fine control means for setting the distance between the singeing means and the expander means.

10. Equipment according to claim 1, wherein the means for displacing the singeing means include gear rack means mounting the singeing heads, drive elements engaging the gear rack means and transmission means mutually coupling the drive elements.

11. Equipment according to claim 10 wherein the transmission means includes a chain transmission mutually coupling the drive elements.

12. Equipment according to claim 10 in which the annular means supporting the singeing means is divided into two separate and mutually complementing parts with a common control for the drive elements.

13. Equipment according to claim 12 including means whereby the annular parts together with the singeing means mounted thereon can be tipped away from the expander means.

* * * * *